US010082101B2

(12) United States Patent
Freidhager et al.

(10) Patent No.: US 10,082,101 B2
(45) Date of Patent: Sep. 25, 2018

(54) LIGHTWEIGHT CONSTRUCITON OF A DIESEL PISTON

(71) Applicant: FEDERAL-MOGUL NURNBERG GMBH, Nuremberg (DE)

(72) Inventors: Marcus Freidhager, Nuremberg (DE); Paul Heinz, Nuremberg (DE); Roland Bohm, Puschendorf (DE)

(73) Assignee: Federal-Mogul Nurnberg GmbH, Nuremberg (DE)

( * ) Notice: Subject to any disclaimer, the term of this patent is extended or adjusted under 35 U.S.C. 154(b) by 0 days.

(21) Appl. No.: 14/907,985

(22) PCT Filed: Jul. 28, 2014

(86) PCT No.: PCT/EP2014/066149

§ 371 (c)(1),
(2) Date: Jan. 27, 2016

(87) PCT Pub. No.: WO2015/014779

PCT Pub. Date: Feb. 5, 2015

(65) Prior Publication Data

US 2016/0169150 A1 Jun. 16, 2016

(30) Foreign Application Priority Data

Jul. 29, 2013 (DE) ..... 10 2013 214 738

(51) Int. Cl.
*F02F 3/00* (2006.01)
*F02F 3/22* (2006.01)

(52) U.S. Cl.
CPC ..... *F02F 3/0015* (2013.01); *F02F 3/0076* (2013.01); *F02F 3/22* (2013.01)

(58) Field of Classification Search
CPC .... F01P 3/06; F01P 3/10; F02F 3/0015; F02F 3/0023; F02F 3/0069; F02F 3/16; F02F 3/20; F02F 3/22; F02F 3/225; F16J 1/04
(Continued)

(56) References Cited

U.S. PATENT DOCUMENTS 5,487,364 A 1/1996 Takeda et al.
5,839,351 A 11/1998 Nakada
(Continued)

FOREIGN PATENT DOCUMENTS

DE 197 34 654 C1 8/1998
DE 19747746 C1 11/1998
(Continued)

*Primary Examiner* — Hung Q Nguyen
(74) *Attorney, Agent, or Firm* — Robert L. Stearns; Dickinson Wright, PLLC

(57) ABSTRACT

The invention relates to a piston (10) for an internal combustion engine, comprising a piston crown (22), a cylindrical piston head (11), which adjoins the piston crown (22), and an at least partially hollow piston skirt (40), which is formed on the piston head (11) on the side facing away from the piston crown (22) and which has two opposite skirt wall segments (50) and two opposite connecting walls (60) that connect the skirt wall segments (50), wherein the connecting walls (60) each have a pin bore (61), wherein the piston head (11) has an annular cooling channel (18), which has at least one inlet opening (28) and at least one outlet opening (30), and the two skirt wall segments (50) widen toward the piston head (11) in such a way that the sector length (L1) of the side of the skirt wall segment (50) formed on the piston head (11) is greater than the sector length (L2) of the side of the skirt wall segment (50) facing away from the piston head (11).

9 Claims, 8 Drawing Sheets

(58) Field of Classification Search
USPC ..... 92/208, 209
See application file for complete search history.

(56) References Cited

U.S. PATENT DOCUMENTS

| | | | | |
|---|---|---|---|---|
| 6,862,977 | B2 | 3/2005 | Glinsner et al. | |
| 8,286,606 | B2 | 10/2012 | Breidenbach et al. | |
| 8,336,446 | B2 | 12/2012 | Frank et al. | |
| 8,662,049 | B2 | 3/2014 | Nodl | |
| 9,243,583 | B2 | 1/2016 | Hirsh | |
| 2002/0046593 | A1* | 4/2002 | Ribeiro | B21K 1/18 72/377 |
| 2003/0037671 | A1 | 2/2003 | Zhu et al. | |
| 2004/0094034 | A1* | 5/2004 | Oversby | F02F 3/00 92/208 |
| 2006/0037471 | A1* | 2/2006 | Zhu | F02F 3/0084 92/173 |
| 2008/0105118 | A1* | 5/2008 | Frank | F16J 1/16 92/208 |

FOREIGN PATENT DOCUMENTS

| | | | |
|---|---|---|---|
| DE | 19908670 | A1 | 11/2000 |
| DE | 60301636 | T2 | 6/2006 |
| DE | 10 2007 058789 | A1 | 6/2009 |
| DE | 10 2009 027 148 | A1 | 12/2010 |
| DE | 102011115639 | A1 | 3/2013 |
| EP | 1 348 859 | A2 | 10/2003 |
| GB | 2347194 | A | 8/2000 |
| JP | S58161146 | U | 10/1983 |
| JP | S61112767 | A | 5/1986 |
| JP | H06346787 | A | 12/1994 |
| JP | 2012127293 | A | 7/2012 |
| WO | 2007031188 | A1 | 3/2007 |

* cited by examiner

LIGHTWEIGHT CONSTRUCITON OF A DIESEL PISTON

BACKGROUND OF THE INVENTION

1. Technical Field

The invention relates to a piston for an internal combustion engine, in particular for a diesel engine. The piston is designed in particular as a cast piston, for example made from aluminium or an aluminium alloy.

2. Related Art

With increasing performance optimisation and/or consumption optimisation of combustion engines, thermal and mechanical stresses on the pistons are increasing. Particularly with regard to the optimisation of consumption, it is desirable to maintain or even improve the strength and durability of the piston while reducing the weight of the same. Several approaches are pursued in relation to this, including optimisation of the piston material, such as the aluminium alloy, improvement of the cooling architecture and other measures.

An improvement of the cooling architecture is disclosed, for example, by DE 10 2009 027 148 A1. A different approach to weight/performance optimisation is disclosed in DE 10 2007 058 789 A1 in which the special design of reinforcing ribs leads to a reduction in the piston weight without compromising the strength of the piston.

Other measures for reducing the weight of the piston while maintaining or even improving the mechanical and thermal strength are desirable with a view to optimising the consumption of the combustion engine.

SUMMARY OF THE INVENTION

An object of the invention is to provide a piston, in particular a cast piston of aluminium or an aluminium alloy, which is optimised with respect to thermal mechanical strength and weight.

The piston according to the invention comprises a piston crown, a cylindrical piston head, which adjoins the piston crown, and an at least partially hollow piston skirt, which is formed on the piston head on the side facing away from the piston crown and which has two opposing skirt wall segments and two opposing connecting walls that connect the skirt wall segments, wherein the connecting walls each have a pin bore. An annular cooling channel which has at least one inlet opening and at least one outlet opening is provided in the piston head. In addition, the skirt wall segments are each widened towards the piston head in such a way that the sector length of the width of the sector wall segment formed on the piston head is greater than the sector length of the side of the skirt wall segment facing away from the piston head.

"Sector length" here is defined as the length with which the corresponding skirt wall segment extends along the cylindrical periphery of the piston. To all intents and purposes, the terms "inlet opening" and "outlet opening" may be understood synonymously since the entrance and exit may be reversed in the cooling channel or both openings may serve as entrances and exits at the same time.

The invention aims to achieve the object by a synergetic interaction of several measures, i.e. from a point of view which is more extensive compared to the prior art. This is achieved in that a cooling architecture, which can effectively reduce the temperatures and thus the thermal and mechanical stresses in the area of the piston crown, is combined with a piston skirt design optimized to the cooling architecture. The widening of the skirt wall segments towards the piston head brings about a stabilisation in the areas of high stress but at the same time allows the connecting walls to be set back inwards, whereby weight is saved due to the resulting reduction in distance between the two pin bores. The weight reduction is due on the one hand to the fact that the circumferential length or circumferential surface of the piston skirt is decreased by moving the connecting walls inwards. On the other hand, the wall thicknesses of the piston skirt can be reduced since the force distribution is more favourable due to the small distance between the two pin bores. It is important in this case that the piston skirt design described above only displays the effects described and can only be realised with significant weight savings if cooling takes place in the piston head.

Preferably, the inlet opening and/or outlet opening of the annular cooling channel is located in the region of a skirt wall segment and/or in the region of a connecting wall. As a result, the cooling oil jet can be routed on the inside of the corresponding skirt wall segment and/or on the inside wall of the corresponding connecting wall, whereby the oil jet can be injected into the cooling channel with low losses. This results in very efficient cooling which in turn permits optimisation of the piston skirt design.

The shortest sector length of at least one of the skirt wall segments is preferably located between the side formed on the piston head and the side facing away from the piston head. In other words, the edge of the corresponding skirt wall segment which faces away from the piston head does not have the longest sector length. Instead, the skirt wall segment tapers (starting from the piston crown) to a minimum sector length and then repeatedly widens, which results in optimisation of the connection between the corresponding skirt wall segment and the connecting walls.

The sector length described above is preferably located closer to the side of the piston head than to the side facing away from the piston head. In other words, a rapid tapering of the corresponding skirt wall segment initially occurs starting from the piston head and then there is a slow widening. With this skirt wall geometry, further optimisation takes place in respect of the ratio between weight and stability of the piston.

The skirt wall segments preferably each have two edges which join the side of the skirt wall segment formed on the piston head to the side of the same skirt wall segment facing away from the piston head, wherein the edges have a portion which is convexly curved starting from the piston crown. The convex curvature stabilises the connection of the skirt wall segment in the region of the piston head on the corresponding connecting walls, which results in the strength and durability of the piston being improved with a weight which is unchanged or hardly changed.

Preferably, the convexly curved portions of the edges each transition into a concave curvature and then extend substantially in a straight line. A curvature in the immediate vicinity of the piston head is not necessarily required hero for joining to the connecting walls.

The straight sections preferably do not run parallel, rather the gap increases, starting from the minimum sector length, to the side of the skirt segment which faces away from the piston head. The widening preferably takes occurs with a smaller or even significantly smaller gradient compared to the convex section. The widening described here represents a good compromise between stability of the piston skirt and weight savings.

The connecting walls preferably each have a pin boss in which the relevant pin bore is located, the pin bosses having an increased wall thickness compared to the other sections of the connecting walls. The regions of the pin bore are areas of high mechanical and thermal stress. It is therefore important as regards the stability of the pin for the pin bosses to have a high wall thickness. Other segments, even such segments which represent a connection to the skirt wall segments or a transition to the skirt wall segments, may have a lower wall thickness by comparison to this without the stability of the piston being noticeably compromised. The special concentration of the piston skirt material on the pin bores is favoured in that the skirt wall segments according to the invention permit the connecting walls to be set back towards the inside of the skirt. For further reinforcement of the pin bosses, they may each be provided with a brass bush.

The pin bosses preferably extend substantially outwards starting from the segments with thinner wall thickness of the relevant connecting walls. Due to the piston skirt design described above, the connecting walls may be set back a long way into the interior which, as set out above, is advantageous as regards weight saving. As a result of this, the pin bosses protrude outwards compared to the thinner sections of the connecting walls.

The piston is preferably made from aluminium or an aluminium alloy. Compare to cast pistons, forged pistons generally have a denser metal structure, they are therefore lighter than cast pistons with comparable strength. Thus measures for reducing the weight play a very important role particularly in cast pistons, made of an aluminium alloy for example. Therefore, the person skilled in the art will not generally consider a one-to-one transfer of structural features from a forged piston to a cast piston.

Two reinforcing ribs, which run largely parallel to the pin axis, are preferably provided, they are formed on the piston head and extend into the cavity of the piston skirt. On the one hand, the reinforcing ribs stabilise the piston skirt in areas of high stress. On the other hand, they enable a reduction in the wall thickness of the piston skirt and therefore, despite the additional material for the reinforcing ribs, enable a decrease in the overall weight. The reinforcing ribs may be quite small in design such that, according to a preferred embodiment, they extend into the piston skirt no further than up to the lower vertex (i.e. the vertex closest to the piston head) of the pin bores. The reinforcing ribs are preferably formed on the pin bosses and connect them in a continuous manner. In the regions of the connection, the reinforcing ribs may have an increased wall thickness.

The reinforcing ribs are preferably arch-shaped in design, extend substantially from one pin bore to the other pin bore, are formed on the piston head and extend into the cavity of the piston skirt. In addition or alternatively to the features discussed above, which relate to the reinforcing ribs, they are thus preferably curved parallel to the piston crown along their direction of extension, which results in an improvement of the mechanical strength and durability of the piston.

The inlet opening and the outlet opening are preferably located between a reinforcing rib and the nearest skirt segment. As a result of this, even better guidance of the splash oil jet is possible which leads to an improved cooling effect and therefore to an improvement of the thermal and mechanical strength of the piston.

The inlet opening and/or the outlet opening is preferably provided outside the piston skirt, as a result of which the skirt can be designed even more compactly and thus save more weight. The inlet opening and/or the outlet opening may be provided in this case in the joining region between pin boss and adjacent connecting wall, as a result of which excellent guidance into or out of the corresponding opening is accomplished.

The invention has been described on the basis of a lightweight piston. Further advantages and features of the invention will become apparent from the following description of preferred embodiments. The features described there and above may be implemented alone or in combination as long as the features are not contradictory. The following description of the preferred embodiments is provided with reference to the associated drawings.

DETAILED DESCRIPTION

FIGS. 1 to 8 show a piston 10 according to a first embodiment in various views and perspectives. The reference numbers are used uniformly and are not described again for each figure. Moreover, some reference numbers have been omitted in one or other view if required for the sake of clarity.

Figure 1:
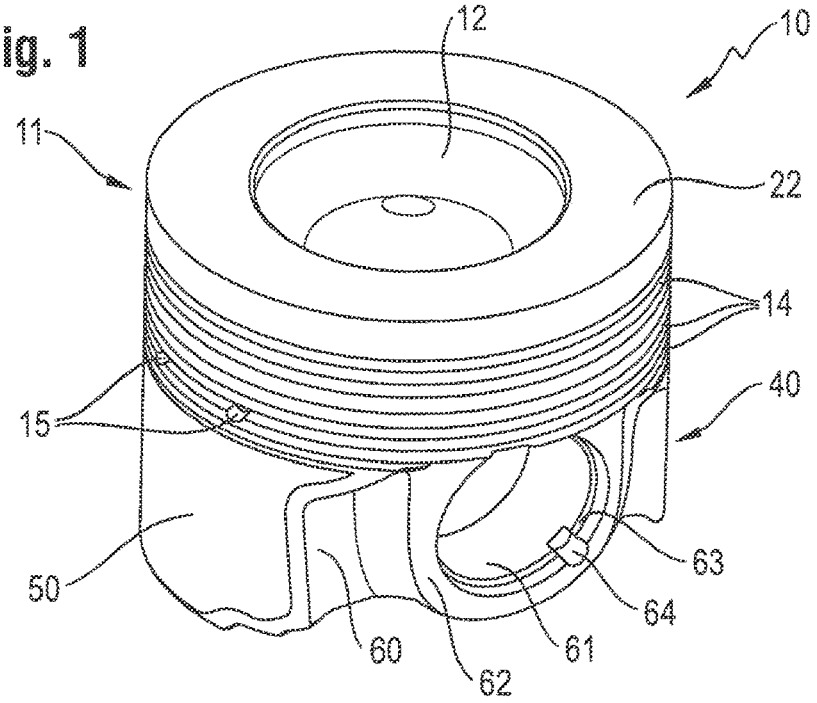
FIG. 1 is a three-dimensional representation of a piston at an angle from above.

FIG. 1 shows a piston 10 in a three-dimensional view at an angle from above. The piston 10, which is preferably cast from aluminium or an aluminium alloy, comprises a combustion bowl 12 which in the present example is w-shaped, as is particularly clear from FIG. 7. The piston 10 is shown there in a sectional view. Starting from the piston crown 22, the combustion bowl 12 extends into the piston head 11. The curvature of the wall forming the combustion bowl 12 is initially convex, then transitions into a concave curvature which, in the manner of an undercut, cuts not only into the depth but also the width of the piston head 11, then adjoining this displays an approximately straight line section which transitions into a centrally located protrusion (the central protrusion of the "ω"), This curve progression is rotationally symmetrical, i.e. mirror-symmetrical in the section of FIG. 7, relative to the central axis of the piston 10.

Several annular grooves 14 are provided for piston rings which are not illustrated. Holes, blind holes, through-holes or other openings 15 may be introduced in one or more of the annular grooves 14 to improve the oil supply to the piston and inside the skirt. The oil that is stripped from the piston rings, which are not illustrated, may be transported, for example, into the interior of the piston through the openings 15.

Figure 2:
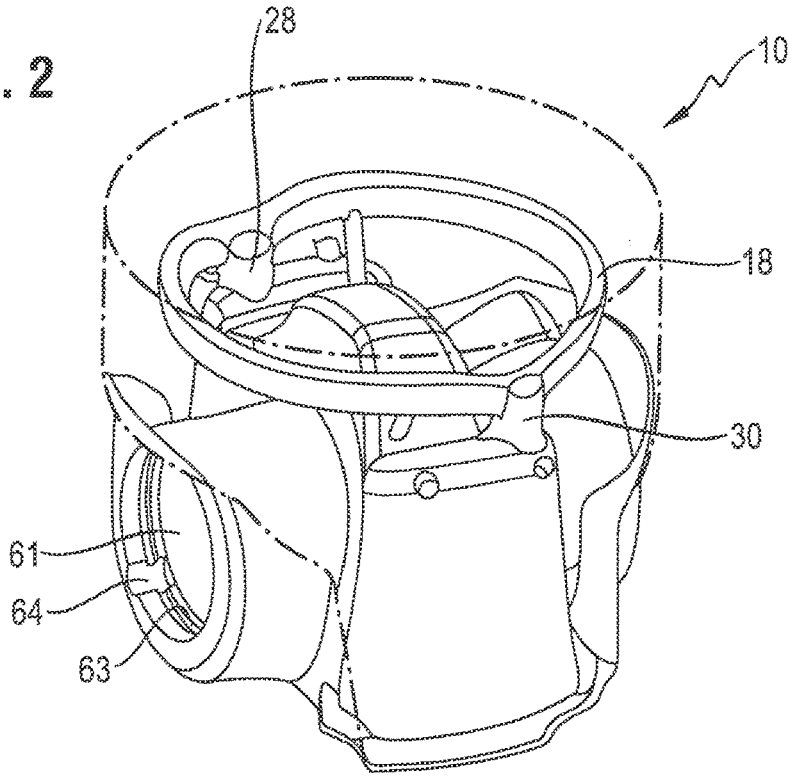
FIG. 2 shows the piston of FIG. 1 in a partially transparent form of representation.
Figure 3:
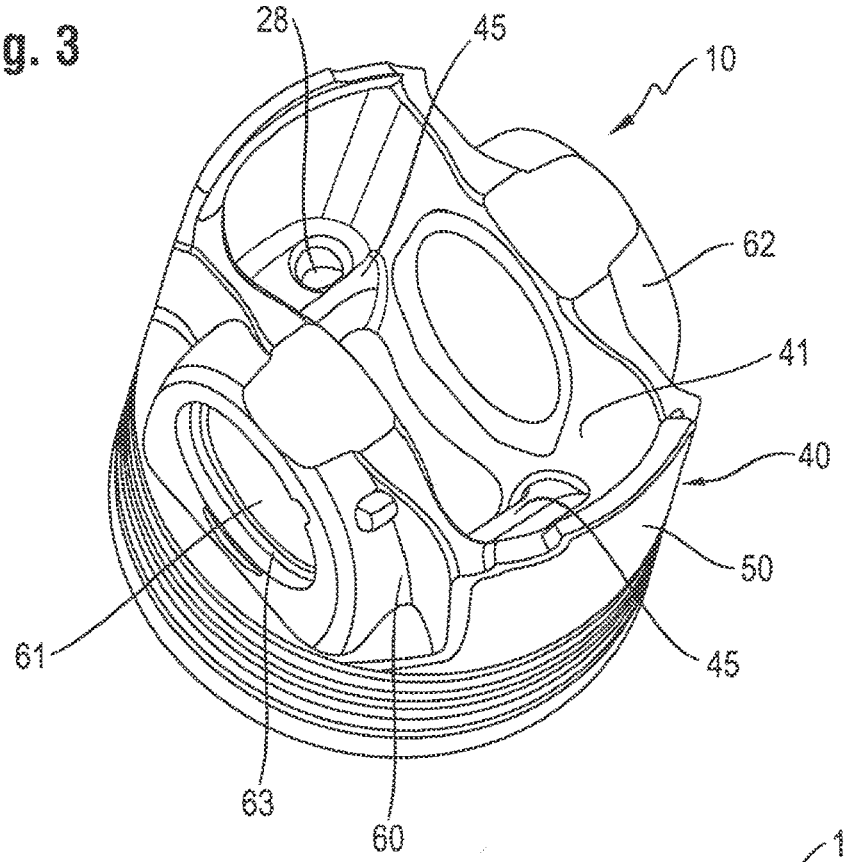
FIG. 3 shows the piston of FIG. 1 at an angle from below.
Figure 4:
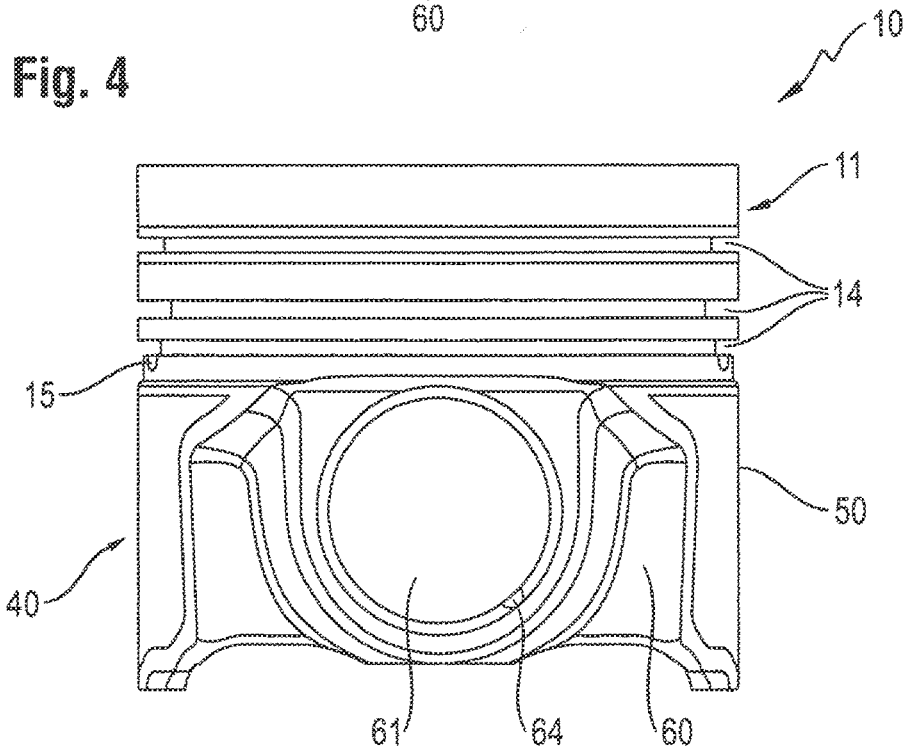
FIG. 4 is a lateral view of the piston of FIG. 1.
Figure 7:
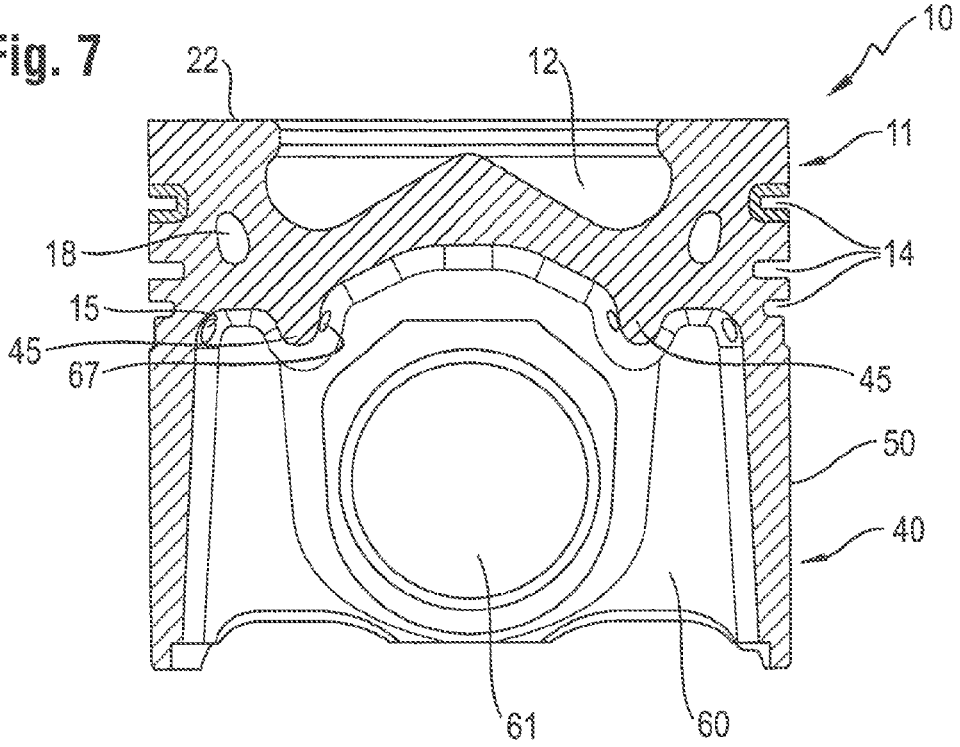
FIG. 7 is a sectional view of the piston of FIG. 1.
Figure 8:
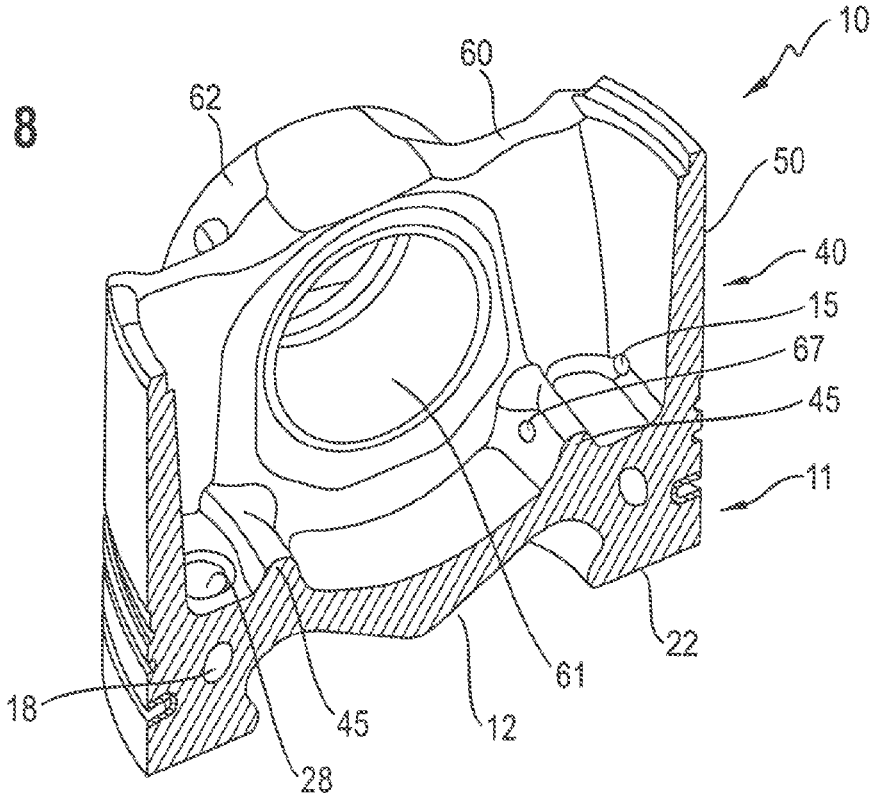
FIG. 8 is a three-dimensional view of the sliced open piston of FIG. 1.

Located in the piston head 11 is an annular cooling channel 18 which is shown in FIG. 2 and is also apparent in FIGS. 7 and 8. The cooling channel 18 runs approximately circular and concentrically to the cylindrical periphery of the piston 10. The diameter of the cooling channel ring is adjusted in such a way that it is provided in the vicinity of the largest depressions of the combustion bowl 12 and at the same time has a sufficient distance from it so as not to compromise the mechanical strength of the piston head 11 due to any thin wall thickness between combustion bowl 12 and cooling channel 18. It can be seen from FIG. 2 that the cooling channel 18 does not necessarily have to extend exactly in a plane which is present parallel to the piston crown 22. In fact, in the present example the cooling channel 18 has a curved shape in which high-lying areas and low-lying areas (in the direction of the piston axis) are connected to each other in a gently curved manner.

The cooling channel 18 has a coolant inlet opening 28 and a coolant outlet opening 30. The coolant inlet opening 28 and the coolant outlet opening 30 extend into the cavity of the piston 10 which is defined by the piston skirt 40 and is described in greater detail below. The coolant inlet opening 28 and the coolant outlet opening 30 are preferably provided in the low-lying areas of the cooling channel 18, as is apparent from FIG. 2. Coolant may be actively injected into the coolant inlet opening 28 or the coolant outlet opening 30 via a nozzle which is not illustrated. Additionally or alternatively, splash oil may be supplied. In addition, coolant exits from the coolant inlet opening 28 and/or coolant outlet opening 30 and, due to the favourable position of the openings, reaches areas of the piston pin, the bearing of the pin in the pin bores and the connection between the piston pin and connecting rod eye to be cooled and lubricated. A representation of the piston pin and the connecting rod has been omitted for the sake of clarity.

The piston skirt 40 comprises two opposing skirt wall segments 50 and two opposing connecting walls 60 connecting the skirt wall segments 50. The connecting walls 60 are moved inwards in relation to the cylindrical piston head 11 such that the overall contour in the section in FIG. 6 of the piston skirt 40 assumes not a circular cylindrical but rather a rectangular shape. In this case, however, the skirt wall segments 50, in conformity with the circular cylindrical contour of the piston head 11, display a circular cylindrical curve which transitions essentially into straight connecting walls 60. It should be noted here that the connecting walls 60 need not be exactly straight but, as is particularly clearly shown in FIG. 6, may be slightly arched or curved. Particularly in the connecting areas to the skirt wall segments 50, the connecting walls 60 display a curvature directed outwards, as a result of which the connecting areas between skirt wall segments 50 and connecting wall 60 may be widened for stabilisation.

The cavity 41 of the piston skirt 40 is comparatively narrow due to moving the connecting walls 60 inwards. A pin bore 61 which is reinforced with pin boss 62 is provided in each of the connecting walls 60. The pin bores 61 may have one or more side reliefs 64. On the underside of the piston 10, the pin bosses 62 are flattened, as is particularly apparent from FIG. 6. The pin bores 61 may be fitted with a circlip which is incorporated in a groove 63 formed in the pin bore 61.

Figure 6:
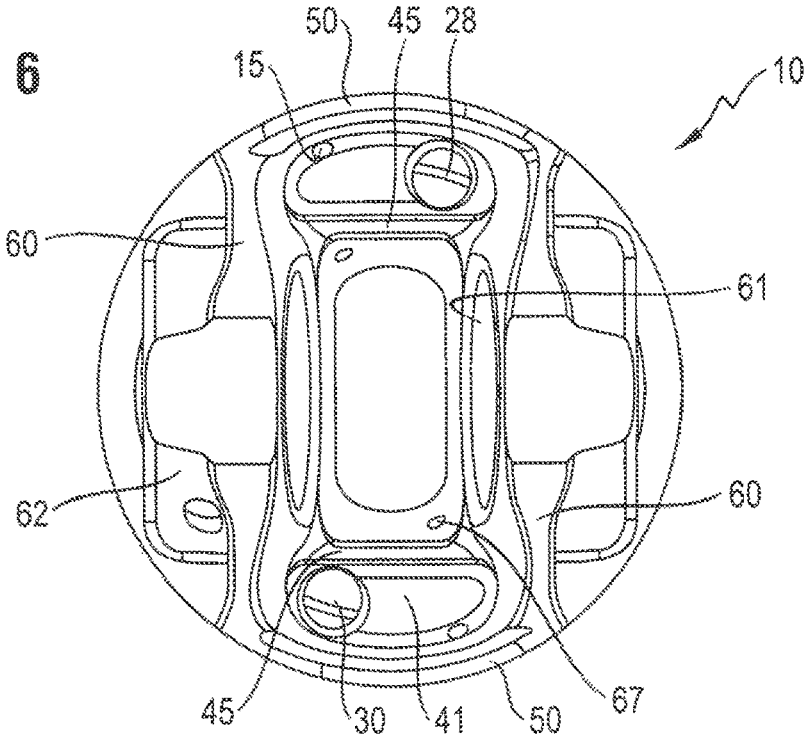
FIG. 6 shows the piston of FIG. 1 from below.

Two reinforcing ribs 45 extend parallel to the pin axis which is defined by the two pin bores 61. The two reinforcing ribs 45 are provided symmetrically on both sides of the pin, which is not shown, and connect the opposing connecting walls 60 in the region of the rear of the pin boss 62. The reinforcing ribs 45 extend into the cavity of the piston skirt 40. In the present example, they end at the height along the piston axis approximately where the vertex of the pin bore 61, which is closest to the piston head 11, is located. In the section which is shown in FIG. 6, the reinforcing ribs 45 extend in an approximately straight line along the pin axis. The upper edges of the reinforcing ribs 45, i.e. the edges which face away from the piston head 11, are rounded off. Moreover, the reinforcing ribs 45 widen in the region of their connection to the connecting walls 60. Overall, all the connections of various components of the piston skirt 40 are executed smoothly, i.e. sharp edges and corners are avoided, to minimise the occurrence of cracks and fractures in these sensitive areas. In addition, openings 67 may be provided in the reinforcing ribs 45 or other skirt segments to improve oil circulation or coolant circulation in the piston skirt 40.

Figure 9:
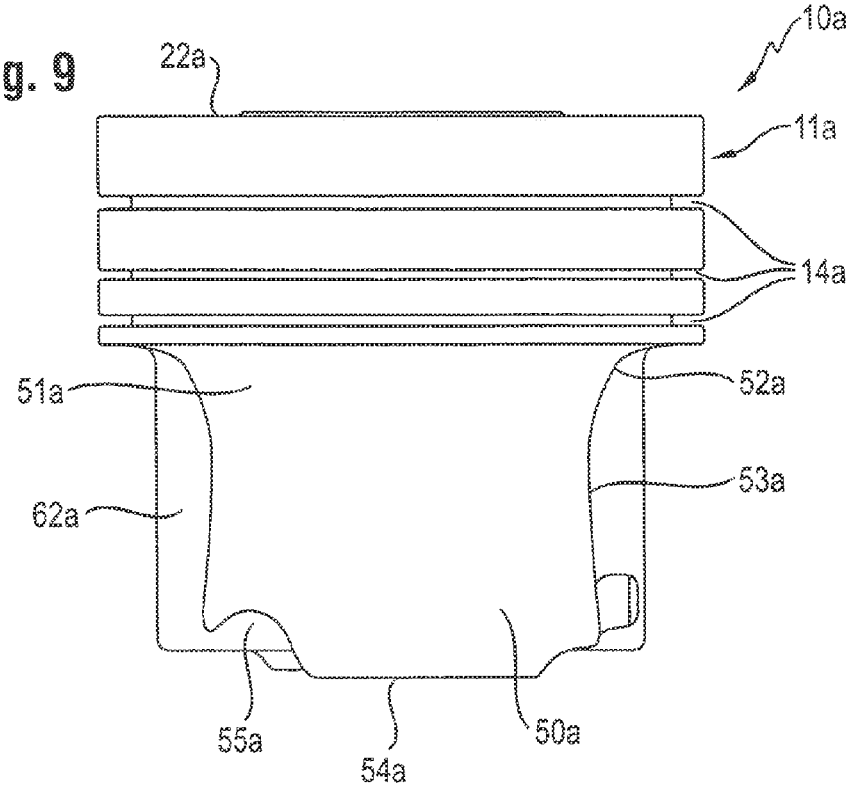
FIG. 9 is a lateral view of the piston according to a second embodiment.
Figure 10:
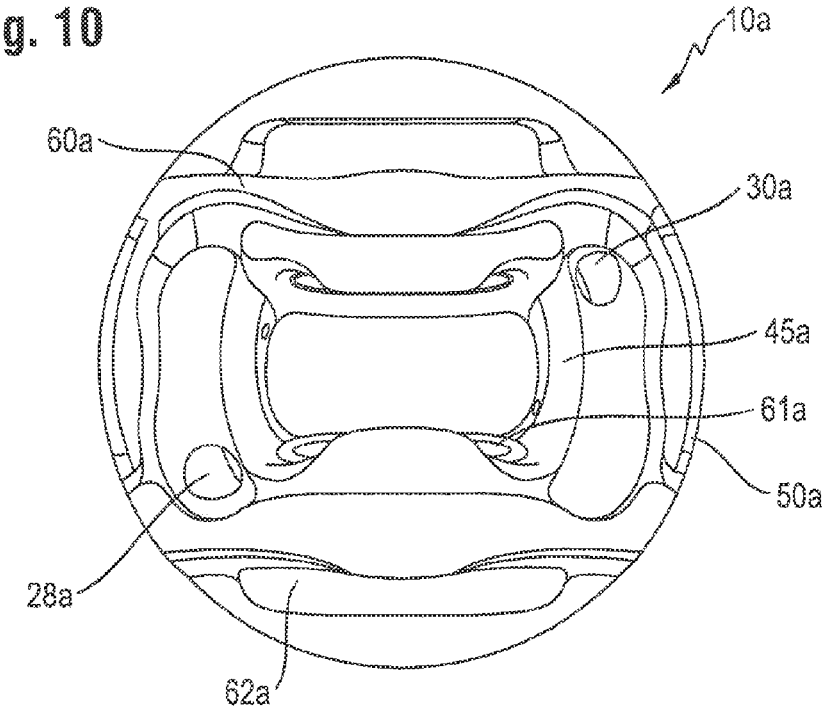
FIG. 10 shows the piston of FIG. 9 from below.
Figure 11:
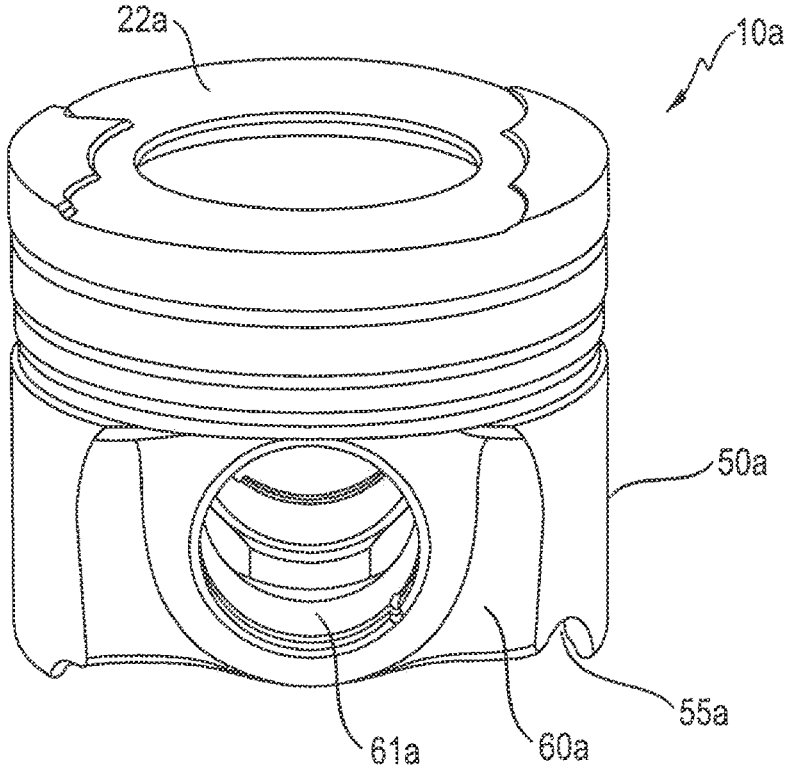
FIG. 11 is another lateral view of the piston of FIG. 9.
Figure 12:
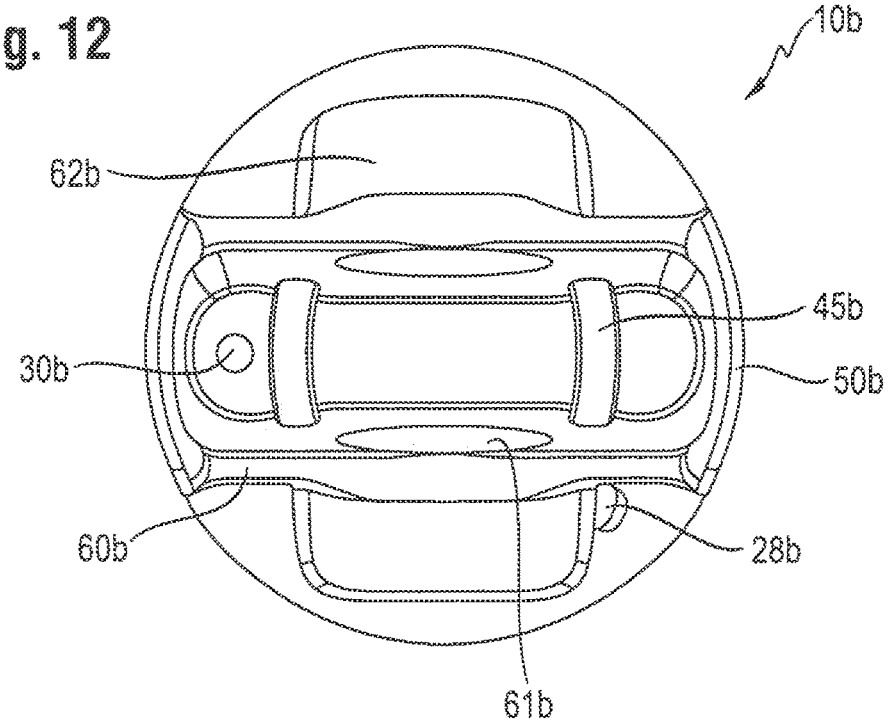
FIG. 12 shows the piston according to a third embodiment from below.
Figure 13:
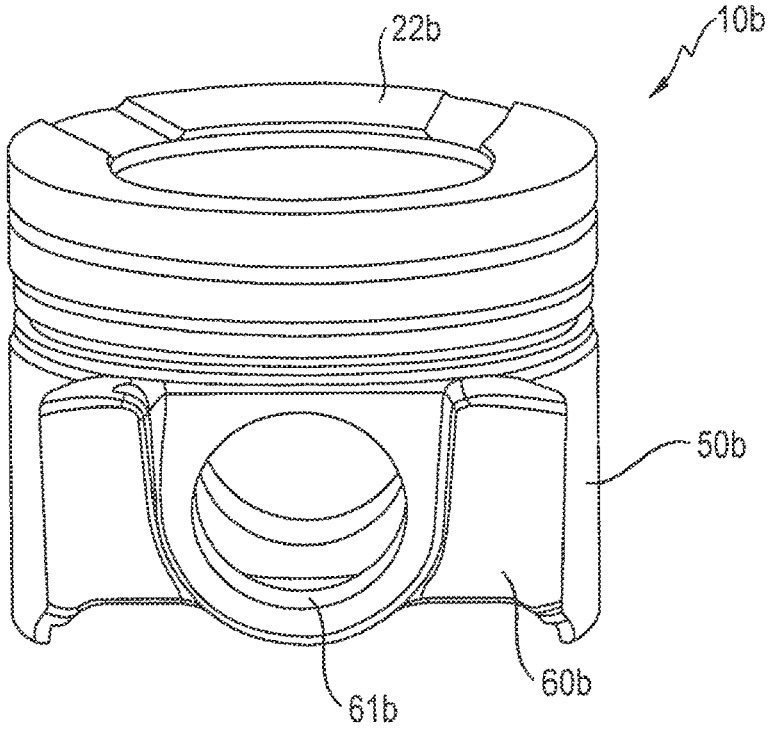
FIG. 13 shows the piston of FIG. 12 from the side.
Figure 14:
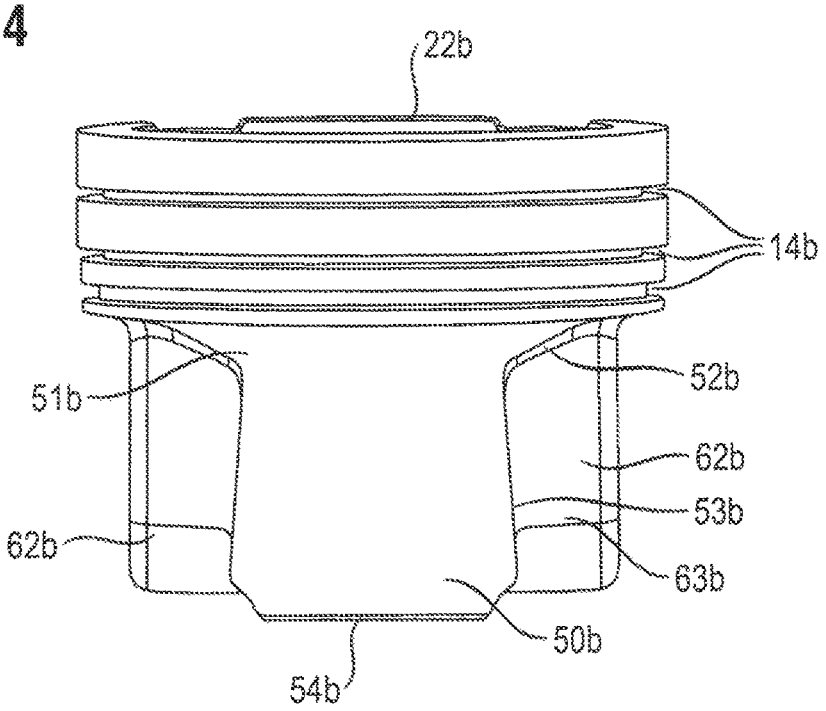
FIG. 14 is another lateral view of the piston of FIG. 12.

The reinforcing ribs need not run in a straight line along the pin axis, as is apparent from FIG. 10 which, together with FIGS. 9 and 11, represents a second embodiment. In it, the reference numbers which correspond to the components of the first embodiment are provided with an "a". The reinforcing ribs 45*a* are curved in the direction of the pin axis, the curvature following the cylindrical profile of the piston head 11, i.e. seen from the piston axis the reinforcing ribs 45*a* are convexly curved. With the curvature of the reinforcing ribs 45*a* illustrated in FIG. 10, the stability of the piston 10 is further improved without increasing the overall weight.

In the embodiment which is shown in FIGS. 9 and 10, the skirt wall segments 50*a* are additionally bulbous. In this case, the inner contour of the skirt wall segments in the section in FIG. 10 have a curved shape such that widening of the skirt wall segments occurs, with the greatest thickness on the central axis of the piston, said central axis being perpendicular to the pin axis and the piston axis.

Figure 5:
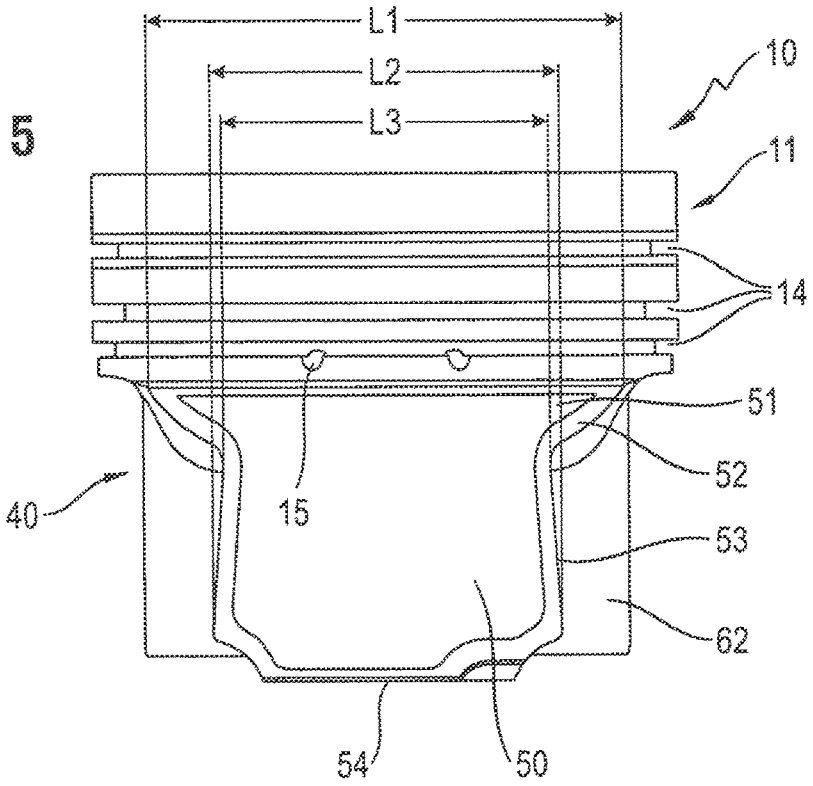
FIG. 5 is a different lateral view of the piston of FIG. 1.

The special shape of the skirt wall segments 50 is apparent from FIG. 5. A widening 51 is provided in the region of the connection of the skirt wall segment 50 to the piston head 11. In other words, the sector length L1 in the region of the connection to the piston head 11 is greater than the sector length L2 of the opposing edge 54, i.e. the edge of the skirt wall segment 50 which opposes the piston head 11. Starting from the connecting region on the piston head 11, a rapid tapering initially takes place via segments 52 to a minimum sector length L1 Segments 52 are convexly curved and transition in the region of the minimum sector length L3 into concavely curved segments. Adjoining this are straight line segments 53 which do not run parallel but gradually diverge up to sector length L2. The following applies here: L1>L2>L3

As is apparent from FIG. 5, the edge 54 may be irregular, i.e. it may have depressions, bevels, curvatures of different types and the like. Reference is made here, by way of example, to the recess 55*a* in FIGS. 9 and 11 which ensures the piston runs correctly with a coolant nozzle placed in the region of the recess for injecting cooling oil into the coolant inlet opening 28*a*.

With the design of the skirt wall segments 50 described above and illustrated in the figures, there is an excellent connection to the connecting walls 60 as a result of which high stability and strength is achieved with simultaneous reduction of the piston weight.

As is apparent from FIG. 6, the coolant inlet opening 28 and the coolant outlet opening 30 are provided between the reinforcing ribs 45 and the nearest skirt wall segment 50. Moreover, they are located in the connecting region between skirt wall segment 50 and connecting wall 60, i.e. in the corner between the two, as a result of which excellent guidance of the coolant inflow occurs along the corresponding inner walls of the piston skirt 40. The openings 28, 30 are thus offset from the central axis of the piston 10 which runs perpendicular to the pin axis and perpendicular to the piston axis. Targeted injection using a nozzle which is not illustrated is thus simplified, thereby improving the cooling effect. It should be pointed out at this point that the terms "coolant inlet opening" and "coolant outlet opening" are to be understood synonymously since the entrance and the exit may be reversed or both openings may serve as entrances and exits at the same time.

FIGS. 12 to 15 show various views of a third embodiment. In them, the reference numbers which correspond to the components of the first embodiment are provided with a "b".

According to the third embodiment, the coolant inlet opening 28*b* and the coolant outlet opening 30*b* are not provided in the connecting region of the skirt edge segment 50*b* and the connecting wall 60*b*, and also not between the piston skirt 40 and the nearest reinforcing rib, the coolant inlet opening 28*b* is rather provided outside the piston skirt 40 in the region of the joint between pin boss 62*b* and connecting wall 60*b*. In addition, the coolant outlet opening 30*b* is provided approximately on the plane bisecting the piston which is perpendicular to the pin axis and between the skirt wall segment 50*b*, which is distant from the coolant inlet opening 28*b*, and the nearest reinforcing rib 45*b* to this. According to an embodiment which is not illustrated, both the coolant inlet opening 28*b* and also the coolant outlet opening 30*b* are provided outside the piston skirt, especially preferably in the region of the connection between pin boss 62*b* and connecting wall 60*b*.

Figure 15:
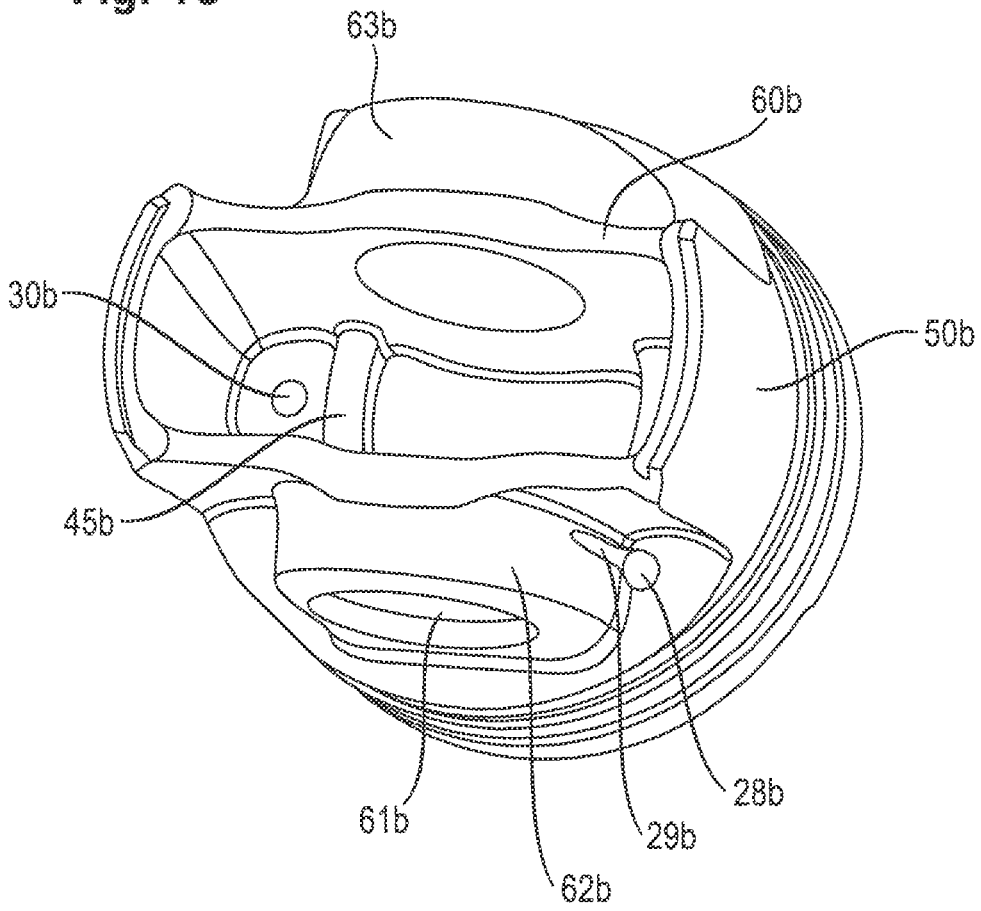
FIG. 15 shows the piston of FIG. 12 at an angle from below.

In FIG. 15, the piston of the third embodiment is shown at an angle from below. Here, the pin boss 62*b* nearest the coolant inlet opening 28*b* has a recess 29*b* which makes it easier to introduce the cooling oil into the coolant inlet opening 28*b*. The other pin boss 62*b* has a reinforcement 63*b* for stabilisation.

In addition to the position of the coolant inlet opening, the coolant outlet opening and the shape and nature of the reinforcing ribs, the embodiments also differ in the shape of the skirt wall segments. From FIG. 9, which comprises a lateral view of the second embodiment, it is apparent that, starting from the connecting region on the piston head, there is no need for any convex curvature of the segments 52, they may, however, be concavely curved, taper rapidly and straight sections 53 which are not parallel but gradually diverge may subsequently adjoin. A gently undulating shape of the segments 52 is apparent from FIG. 14 of the third embodiment.

To avoid redundancy, the description of the second and third embodiments is kept less detailed than that of the first embodiment. It is therefore explicitly pointed out that the features and technical effects of the first embodiment also apply to the second and third embodiments as long as they do not contradict the representations of the first embodiment.

The invention claimed is:

1. A piston for an internal combustion engine, the piston being cast of aluminum or an aluminum alloy and comprising a piston crown, a cylindrical piston head, which adjoins the piston crown, and an at least partially hollow piston skirt, which is formed on the piston head on the side facing away from the piston crown and which has two opposing skirt wall segments and two opposing connecting walls that connect the skirt wall segments, wherein the connecting walls each has a pin bore extending along a pin axis, wherein the piston head has an annular cooling channel, which has at least one inlet opening and at least one outlet opening, and the two skirt wall segments widen towards the piston head in such a way that a sector length (L1) of the side of the skirt wall segment formed on the piston head is greater than a widest sector length (L2) of the side of the skirt wall segment facing away from the piston head, and a shortest sector length (L3) of at least one of the skirt wall segments is located between the side formed on the piston head and the side facing away from the piston head, and the width of the at least one of the skirt wall segments increases continuously from the shortest sector length (L3) to the widest sector length (L2) of the side facing away from the piston head, two reinforcing ribs, which run largely parallel to the pin axis or run in an arch shape and extend essentially from one pin bore to the other pin bore, are formed on the piston head and extend into a cavity of the piston skirt, and the inlet opening and the outlet opening are each provided between an associated one of the reinforcing ribs and the associated nearest skirt wall segment.

2. The piston according to claim 1, wherein the inlet opening and/or outlet opening is located in the region of the associated nearest skirt wall segment and/or in the region of an associated one of the connecting walls.

3. The piston according to claim 1, wherein the shortest sector length (L3) is located closer to the side formed on the piston head than the side facing away from the piston head.

4. The piston according to claim 1, wherein the opposing skirt wall segments have two edges which join the side of the skirt wall segment formed on the piston head to the side of the same skirt wall segment facing away from the piston head, wherein the edges have a portion which is convexly curved starting from the piston head.

5. The piston according to claim 4, wherein the convexly curved portions of the edges each transition into a concave curvature and then extend substantially in a straight line.

6. The piston according to claim 5, wherein the straight line portions of the edges do not run parallel and/or their distance from the side of the skirt wall segment, which faces away from the piston head, increases.

7. The piston according to claim 1, wherein the connecting walls each has a pin boss in which the relevant pin bore is located and which has an increased wall thickness relative to thinner wall segments of the connecting walls.

8. The piston according to claim 7, wherein the pin bosses extend substantially outwards starting from the segments with thinner wall thickness of the relevant connecting walls.

9. A piston for an internal combustion engine, the piston being cast of aluminum or an aluminum alloy and comprising a piston crown, a cylindrical piston head, which adjoins the piston crown, and an at least partially hollow piston skirt, which is formed on the piston head on the side facing away from the piston crown and which has two opposing skirt wall segments and two opposing connecting walls that connect the skirt wall segments, wherein the connecting walls each has a pin bore extending along a pin axis, wherein the piston head has an annular cooling channel, which has at least one inlet opening and at least one outlet opening, and the two skirt wall segments widen towards the piston head in such a way that a first sector length (L1) of the side of the skirt wall segment formed on the piston head is greater than a second sector length (L2) of the side of the skirt wall segment facing away from the piston head, and a shortest sector length (L3) of at least one of the skirt wall segments is located between the first sector length (L1) of the side of the skirt wall segment formed on the piston head and the second sector length (L2) of the side of the skirt wall segment facing away from the piston head, the skirt wall segments include a concavely curved portion in a section extending from the piston head, a tapered portion extending from the concavely curved section, and straight sections extending from the tapered portion which gradually diverge.

* * * * *